US007086265B2

(12) United States Patent
Lösch

(10) Patent No.: US 7,086,265 B2
(45) Date of Patent: Aug. 8, 2006

(54) METHOD FOR CONTROLLING THE MATERIAL FLOW DURING THE DEEP-DRAWINGS OF SHEET METAL, AND DEEP-DRAWING TOOL

(75) Inventor: Alfred Lösch, Tholey-Hasborn (DE)

(73) Assignee: Nothelfer GmbH (DE)

( * ) Notice: Subject to any disclaimer, the term of this patent is extended or adjusted under 35 U.S.C. 154(b) by 78 days.

(21) Appl. No.: 10/512,803

(22) PCT Filed: Jun. 14, 2003

(86) PCT No.: PCT/EP03/06305

§ 371 (c)(1),
(2), (4) Date: Oct. 25, 2004

(87) PCT Pub. No.: WO2004/009263

PCT Pub. Date: Jan. 29, 2004

(65) Prior Publication Data

US 2005/0217344 A1 Oct. 6, 2005

(30) Foreign Application Priority Data

Jul. 20, 2002 (DE) ..... 102 33 008

(51) Int. Cl.
*B21D 24/04* (2006.01)

(52) U.S. Cl. ..... 72/297; 72/351

(58) Field of Classification Search ..... 72/350, 72/351, 296, 297, 348
See application file for complete search history.

(56) References Cited

U.S. PATENT DOCUMENTS 368,526 A * 8/1887 Fowler ..... 72/351
1,035,984 A * 8/1912 Malde ..... 73/329
2,075,847 A * 4/1937 Hothersall ..... 72/329
5,600,991 A 2/1997 Munzen
6,032,504 A 3/2000 Onat et al.

FOREIGN PATENT DOCUMENTS

| | | |
|---|---|---|
| EP | 0 754 508 | 1/1997 |
| EP | 0 806 256 | 11/1997 |
| JP | 56160836 | 12/1981 |
| JP | 59163032 | 9/1984 |
| JP | 04178225 | 6/1992 |

* cited by examiner

*Primary Examiner*—Derris H. Banks
*Assistant Examiner*—Debra M. Wolfe
(74) *Attorney, Agent, or Firm*—McGlew & Tuttle, PC

(57) ABSTRACT

A method for controlling the material flow during the deep-drawing of sheet metal involves compressing the edges of the sheet metal (1) between at least one upper stopper (13) and at least one lower stopper (6, 7) during the deep-drawing process, with a controllable elastic force (8, 9). A corresponding deep-drawing tool is also provided. A Z-shaped blocking step (11) is stamped into the edge (1*a*) of the sheet metal when the upper and lower stoppers (13, 6, 7) are closed, the basic shape is then produced by deep-drawing, maintaining the blocking step (11) and completely blocking the sheet metal between the stoppers. The sheet metal (1) is outwardly stretched, and the blocking step (11) is then reduced in terms of height, facilitating the outward displacement of the sheet metal towards the outside. The deep-drawing tool has a lower stopper including an inner stopper (6) and an outer stopper (7). The stoppers are arranged in an annular manner on the edge of the sheet metal (1) and can be displaced in relation to each other in the holding direction.

7 Claims, 3 Drawing Sheets

METHOD FOR CONTROLLING THE MATERIAL FLOW DURING THE DEEP-DRAWINGS OF SHEET METAL, AND DEEP-DRAWING TOOL

FIELD OF THE INVENTION

The invention relates to a method for controlling the material flow during the deep-drawing of sheet metal, preferably made of high-strength steels and/or multiplephase steels or of aluminum as well as to a deep-drawing tool.

BACKGROUND OF THE INVENTION

The use of high-strength steels in car body construction attains ever greater importance within the scope of developing ever lighter motor vehicles. For example, sheet metal plates made of multiple-phase steels are proposed for planking parts. For planking parts made of deep-drawing materials with high hardening values, in particular, it is important that the sheet metal plate is stretched-out over an as "large-surface" as possible. For this purpose, it is state of the art to impede the sheet metal plate trailing from outside by means of a blocking step or blocking bead located on the sheet metal stopper. A disadvantage according to this method might be involved, if the sheet metal impediment remains constant throughout the deep-drawing process, particularly if the sheet metal is stretched-out beyond the 20% critical expansion in considerably deformed areas and towards the end of the deep-drawing process. In an article published by S. Beck under the heading "Steuerung des Ziehprozesses durch aktive Ziehsicken" (Controlling the Deep-Drawing Process by Active Drawing Beads) in the book "Neuere Entwicklungen in der Blechumformung" (Latest Developments in Sheet Metal Forming), editor Klaus Siegert, May 2000, the use of height-adjustable deep-drawing rods is described, which are used in order to control strains and stresses occurring in metal forming and thus to control the flow of material. Constructive solutions solely relate to a relatively expensive adjustment in height of deep-drawing rods.

Moreover, known from EP 806 256 B1 is a method for controlling the material flow during deep-drawing of work pieces like sheet metal forming blanks, wherein the frictional force between work piece and holding-down device is measured through a frictional force sensor to serve as controlling variable for a holding-down force. Also applied therein is a segmented holding-down device in order to control the holding-down force of individual holding-down device segments spread at its periphery. This solution, too, is relatively complicated.

SUMMARY OF THE INVENTION

Now, therefore, it is the object of the present invention to provide a generic method for controlling during deep-drawing of sheet metal plates and an appropriate deep-drawing tool, in which the height adjustment through deep-drawing rods and the expensive frictional force sensors can be dispensed with.

According to the invention, a method is provided for controlling the material flow during the deep-drawing of sheet metal plates, preferably made of high-strength steels and/or multiple-phase steels or aluminum. The method includes forming the sheet metal plate in a press between a die stamp arranged at a base plate and a matrix arranged at a top plate. The die stamp and the matrix have adapted profiled sections for the formation of die beads at the edges of the sheet metal plate. The edges of the sheet metal plate are compressed between at least one upper sheet metal stopper and at least one lower sheet metal stopper during the deep-drawing process, applying a controllable spring load. The method of the invention further includes:

a) initially, as the upper and lower sheet metal stoppers are closed, stamping a Z-shaped blocking step into the sheet metal plate edge;
b) then, by maintaining the blocking step and a complete blocking between the sheet metal stoppers, the drawing of the base form is completed, with the sheet metal plate being stretched-out from inside to outside, and
c) finally, the blocking step is reduced in its height, thus facilitating the sheet metal trailing from outside.

According to another aspect of the invention, a method for controlling the material flow during the deep-drawing of sheet metal plates, preferably made of high-strength steels and/or multiple-phase steels or aluminum is provided. The sheet metal plate is formed in a press between a die stamp arranged at a base plate and a matrix arranged at a top plate. The die stamp and the matrix have adapted profiled sections for the formation of die beads at the edges of the sheet metal plate. The edges of said sheet metal plate are compressed between at least one upper sheet metal stopper and at least one lower sheet metal stopper during the deep-drawing process by applying a controllable spring load. The method further includes initially, mainly without any bead effect, drawing the base form, while the upper and lower sheet metal stoppers rest upon each other mainly evenly, and then stamping a blocking step into the sheet metal plate edge in order to impede the sheet metal trailing from outside to inside.

According to still another aspect of the invention, a deep-drawing tool is provided for the deep-drawing of sheet metal plates, preferably for executing the method discussed above. A die stamp is arranged in a press at a base plate and a matrix is arranged oppositely at a top plate. Profiled sections are arranged at the die stamp and at the matrix for the formation of die beads at the edges of the sheet metal plate to be deformed. At least one upper sheet metal stopper and at least one lower sheet metal stopper are provided. The lower sheet metal stopper includes an inner sheet metal stopper and an outer sheet metal stopper. These stoppers are annularly arranged at the edge of the sheet metal plate and are movable relative to each other in the direction of holding.

Pursuant to the inventive method, a Z-shaped blocking step (see feature (a)) is stamped into the sheet metal plate edge at first, i.e. prior to the actual deep-drawing process as the upper and lower sheet metal plate stoppers are closed, wherein the blocking step is then maintained during completion of the base form drawing, thus creating a complete blocking step by the compressed sheet metal plate stoppers and stretching-out the sheet metal plate from inside towards the outside (see feature (b)). Finally, during the further deep-drawing process, the blocking step is reduced in its height, thus facilitating the sheet metal plate trailing from outside (see feature (c)). By way of the inventive 2-shaped blocking step, the sheet metal plate impediment from outside can be increased on the whole and, by the end of the deep-drawing process, it is possible to reduce and even entirely abandon the sheet metal plate impediment by reducing the height of the blocking step through mechanical off-controlling of the deep-drawing step, so that the sheet metal plate trailing takes place exclusively from outside to inside.

The method being the subject of the present invention may also be applied by reversing the step for the reverse case by performing the deep-drawing process without a blocking step at the beginning, as described according to the other method aspect. This provides the stamping of a blocking step by the aid of the sheet metal holding-down devices only during the deep-drawing process. Hence, the sheet metal plate trailing is impeded by the aid of the blocking step only by the end. This may be of some advantage both for deep-drawing processes with locally substantial deformation, with it being necessary to "serve1" material, and for sheet metal materials having little breaking elongation, e.g. like aluminum.

The constructive solution provides for a deep-drawing tool as mentioned above. At least one sheet metal stopper, preferably the lower sheet metal stopper along the blocking step is divided into an inner and an outer ring and wherein at least one of these rings is movable relative to the other ring in the direction of holding. The two sheet metal stoppers arranged next to each other may create an adjustable blocking step for the edge of the sheet metal plate and be pressed against a corresponding firm step of the counter-stopper in order to attain the desired sheet metal plate impediment. By actuating the outer ring in a holding direction relative to the inner ring, the step can be reduced from its initial height with maximal blocking effect down to any desired drawing depth, and even down to zero in extreme cases. In conformity with the method according to the other method aspect, this process may also be reversed by initially working virtually without any blocking step between the inner and outer sheet metal stopper and then switching-on the effect of the blocking step by increasing the step between the two rings and raising it up to maximal effect till the end.

By way of the inventive bipartite sheet metal stopper and through the relative movement of the outer ring towards the inner ring, a deep-drawing tool with a controllable blocking step is attained. In contrast with mono-acting tools, the matrix and the upper sheet metal stopper are also movable relative to each other. This deep-drawing tool can virtually be applied in all conventional presses with controlled or delayed-trailing die pads.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENT

Figure 1:
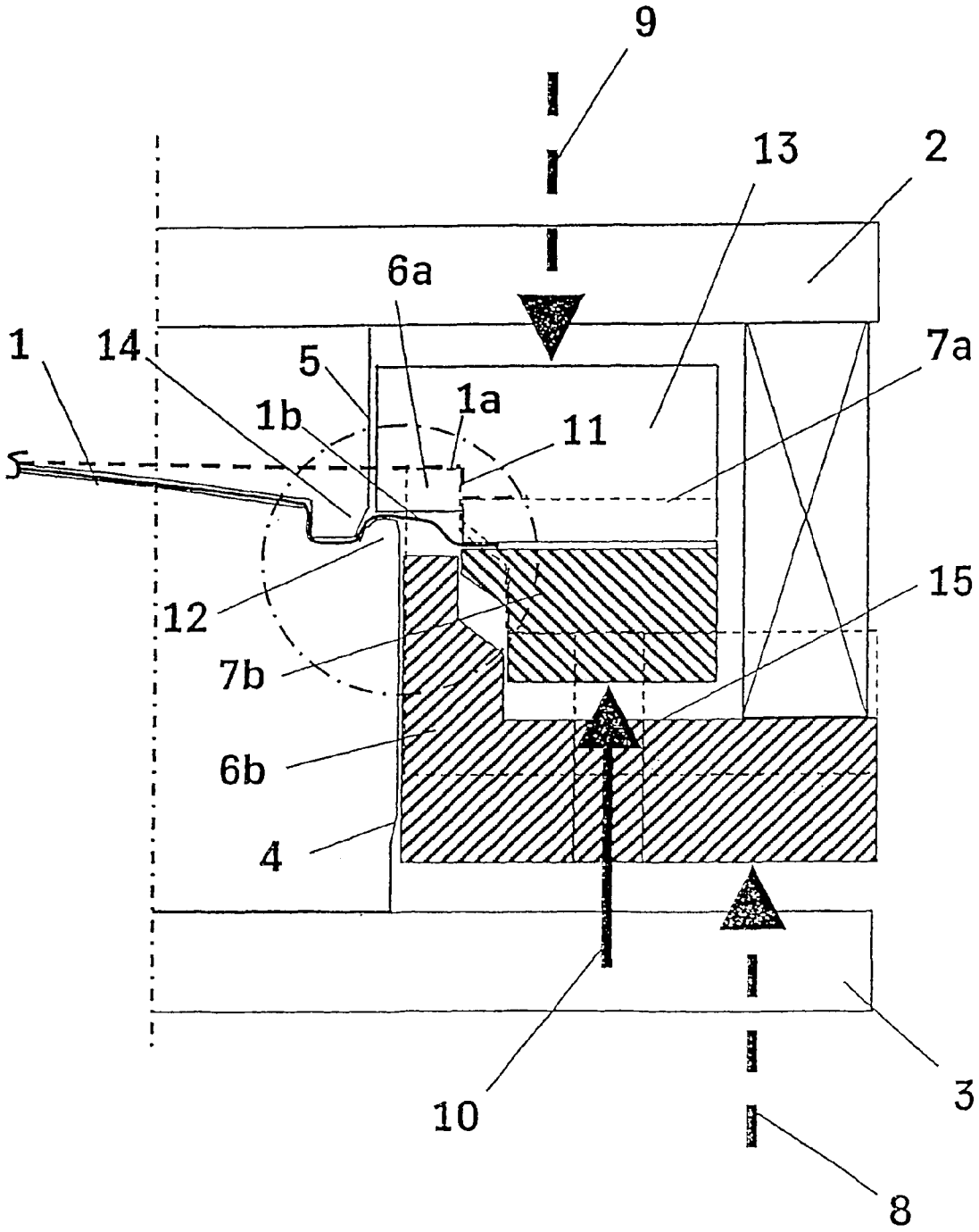
FIG. 1 is a sectional view through the inventive deep-drawing tool between top plate 2 and base plate 3 of a press.
Figure 2:
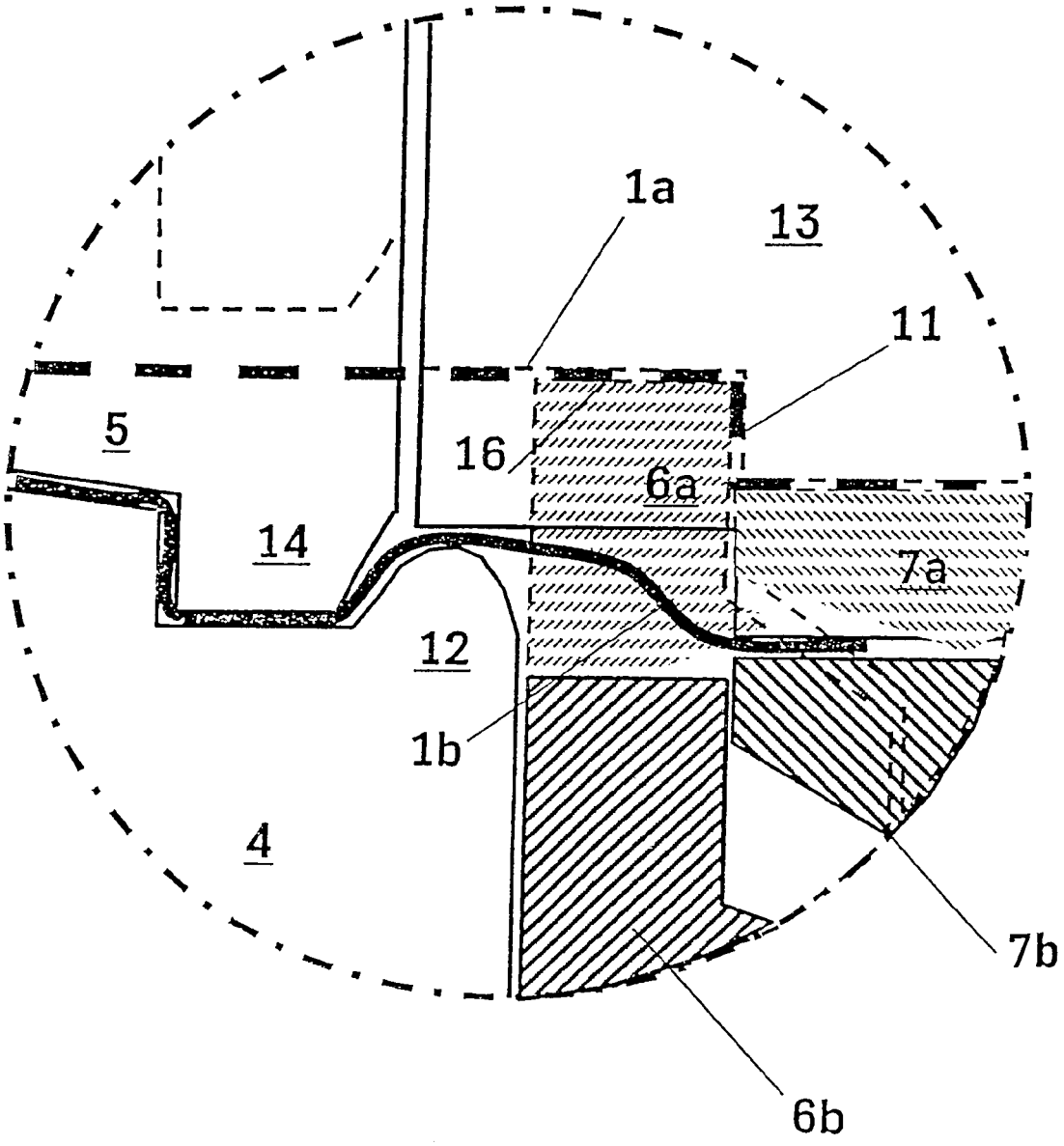
FIG. 2 is an enhanced view of the central area in FIG. 1.

Referring to the drawings in particular, FIG. 1 shows the sheet metal plate 1 prior to the deep-drawing process with the sheet metal plate edge 1*a* as a dashed line with blocking step 11. After the deep-drawing process, the sheet metal plate edge 1*b* is drawn with a continuous line. Sheet metal plate 1 is located between the deep-drawing stamp 4 and matrix 5 that are arranged between top plate 2 and base plate 3 of a conventional press. In a conventional manner, base plate 3 is fixed in stationary arrangement, while top plate 2 is vertically movable for the deep-drawing process. At its underside, the upper sheet metal stopper 13, which is movable relative to a die plate or matrix 5 possesses a step 16 that corresponds to the blocking step 11 of the sheet metal edge 1*a*. During the deep-drawing process, the upper sheet metal stopper 13 is loaded by spring load 9, also designated as top pneumatic force, and pressed against the sheet metal edge. The two lower sheet metal stoppers 6 and 7, which in their upper position 6*a*, 7*a*, prior to the deep-drawing process, are represented with a dashed bordering, act as counter-stoppers. At the lower position 6*b*, 7*b* these two sheet metal stoppers are shown in hatched lines. The inner sheet metal stopper 6 is pressed by spring load (or lower pneumatic force) 8 and the outer sheet metal stopper 7 by the stroke dependent counterforce 10 from the bottom against the edge of sheet metal plate 1. To shape a forming step, stamp 4 possesses a bead 12, while matrix 5 has a corresponding nose 14, which is shown on FIG. 2, particularly in the upper (dashed line) and lower position.

Figure 3:
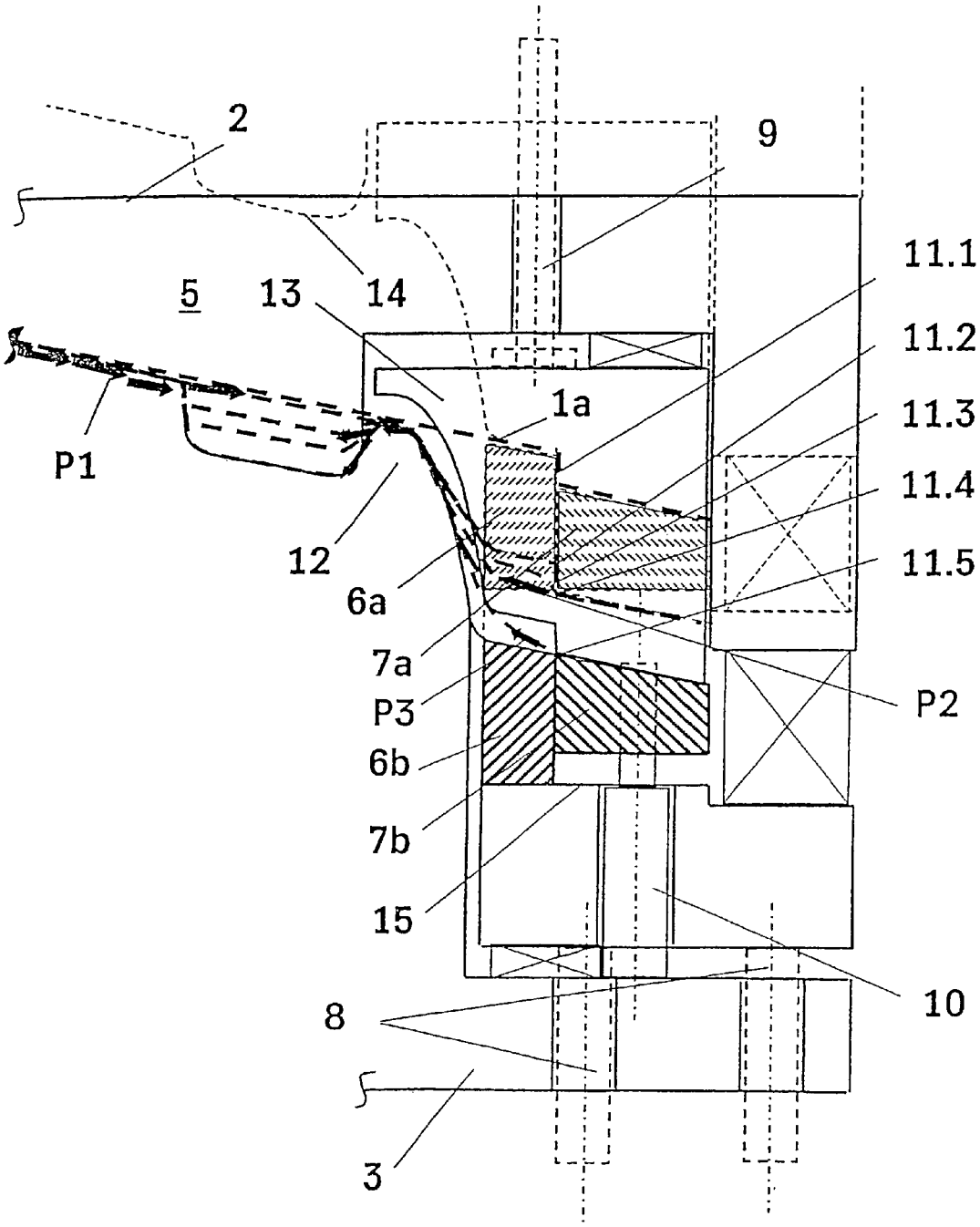
FIG. 3 is a sectional view corresponding to the view as per FIG. 1 showing the controllable blocking step in five different phases.

Shown on FIG. 3, in particular, are five different phases for the position of the two lower, inner and outer sheet metal stoppers 6 and 7:

Phase 1: Close sheet metal stopper

Via the upper sheet metal stopper 13 charged with top force 9 and via the lower sheet metal stoppers 6,7 acting with bottom force 8, a blocking step 11 is stamped with maximal step height 11.1 into the sheet metal plate edge 1*a*. The outer sheet metal stopper 7*a* rests with its underside on the support surface 15 of the inner sheet metal stopper 6*a*.

Phase 2: Stretching the base form

By completely blocking and maintaining the maximal step height 11.2, the base form is drawn completely, with the sheet metal plate being stretched-out exclusively from inside to outside. This direction of material flow is indicated by arrows PI.

Phase 3: Start forming the forming step on the stamp

By causing the stroke-dependent counterforce 10 to act upon the outer lower sheet metal stopper 7, the blocking step is reduced in its step height 11.3, thus facilitating the sheet metal trailing from outside. (vide arrow P2).

Phase 4: Further deforming the forming step

By way of further reducing the blocking step height 11.4, the required sheet metal trailing is caused to intensively take place from outside.

Phase 5: Complete forming

There being no step height 11.5 any longer and because of the virtually dropped blocking step, the sheet metal trailing takes place exclusively from outside (vide arrow P3).

While a specific embodiment of the invention has been shown and described in detail to illustrate the application of the principles of the invention, it will be understood that the invention may be embodied otherwise without departing from such principles.

The invention claimed is:

1. A method for controlling the material flow during the deep-drawing of sheet metal plates, the method comprising:

forming the sheet metal plate in a press between a die stamp arranged at a base plate and a matrix arranged at a top plate;

providing the die stamp and the matrix with adapted profiled sections for the formation of die beads at the edges of said sheet metal plate compressing the edges of said sheet metal plate between at least one upper sheet metal stopper and at least one lower sheet metal stopper during the deep-drawing process, applying a controllable spring load;

initially, as the upper and lower sheet metal stoppers are closed, stamping a Z-shaped blocking step into the sheet metal plate edge;

then, by maintaining the blocking step and a complete blocking between said sheet metal stoppers, completing the drawing of the base form, with said sheet metal plate being stretched-out from inside to outside; and finally, reducing the blocking step in its height, thus facilitating the sheet metal trailing from outside.

2. A method pursuant to claim 1, wherein by the end, through complete abandonment of the blocking step, the sheet metal trailing takes place exclusively from outside to inside.

3. A method for controlling the material flow during the deep-drawing of sheet metal plates, made of high-strength steels and/or multiple-phase steels or aluminum, the method comprising:

forming the sheet metal plate in a press between a die stamp arranged at a base plate and a matrix arranged at a top plate, the die stamp and the matrix having adapted profiled sections for the formation of die beads at the edges of said sheet metal plate; and compressing the edges of said sheet metal plate between at least one upper sheet metal stopper and at least one lower sheet metal stopper during the deep-drawing process, applying a controllable elastic load;

initially, mainly without any bead effect, drawing the base form, while the upper and lower sheet metal stoppers rest upon each other mainly evenly; and then stamping a blocking step into the sheet metal plate edge in order to impede the sheet metal trailing from outside to inside.

4. A deep-drawing tool for the deep-drawing of sheet metal plates, for executing a method including stamping a blocking step into the sheet metal plate edge, said tool comprising:

a die stamp arranged in a press at a base plate and a matrix arranged oppositely at a top plate;

profiled sections arranged at the die stamp and at the matrix for the formation of die beads at the edges of the sheet metal plate to be deformed; and at least one upper sheet metal stopper and at least one lower sheet metal stopper the lower sheet metal stopper including an inner sheet metal stopper and an outer sheet metal stopper, said stoppers being annularly arranged at the edge of said sheet metal plate and being movable relative to each other in the direction of holding.

5. A deep-drawing tool pursuant to claim 4, wherein the lower inner sheet metal stopper has a support surface onto which the outer sheet metal stopper comes to rest in the lower relative position as compared with the inner sheet metal stopper.

6. A deep-drawing tool pursuant to claim 4, wherein the two lower sheet metal stoppers with their upper sides create the blocking step for the edge of said sheet metal plate that is adjustable.

7. A deep-drawing tool pursuant to claim 4, wherein a step corresponding to the maximal step height of said blocking step is arranged at the underside of the upper sheet metal stopper.

* * * * *